US005669823A

United States Patent [19]

McCready

[11] Patent Number: 5,669,823

[45] Date of Patent: Sep. 23, 1997

[54] ADJUSTABLE PUTTER GRIP

[76] Inventor: Stephen McCready, 1936 Illinois Ave., Metairie, La. 70062

[21] Appl. No.: 672,579

[22] Filed: Jun. 28, 1996

[51] Int. Cl.[6] ..... A63B 53/16

[52] U.S. Cl. ..... 473/294; 473/296; 473/299

[58] Field of Search ..... 473/294, 295, 473/296, 298, 299

[56] References Cited

U.S. PATENT DOCUMENTS 760,161 5/1904 Smith ..... 473/294

3,252,706 5/1966 Rosasco ..... 473/300 X 5,388,834 2/1995 Dawson ..... 473/299 X 5,401,022 3/1995 McCready ..... 473/294

*Primary Examiner*—George J. Marlo

[57] ABSTRACT

A putter in combination with an adjustable putter grip including an attachment handle. A clamping mechanism couples the putter to the attachment handle thereby permitting a user to manipulate the putter with their wrists locked and their arms in a parallel relationship. The attachment handle is secured to the putter in a T-shaped configuration and can be adjusted along a length of the putter.

6 Claims, 3 Drawing Sheets

ADJUSTABLE PUTTER GRIP

BACKGROUND OF THE INVENTION

1. Field of the Invention

The present invention relates to an adjustable putter grip and more particularly pertains to securing to a putter to allow a user to putt with arms in a parallel relationship with an adjustable putter grip.

2. Description of the Prior Art

The use of golf putters is known in the prior art. More specifically, golf putters heretofore devised and utilized for the purpose of putting golf balls are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,459,426 to Sherwood discloses a golf putter hand grip.

U.S. Pat. No. 5,401,022 to McCready discloses a tee putter.

U.S. Pat. No. 5,125,657 to Beil discloses a putter with pendulum action.

U.S. Pat. No. 3,874,668 to Flege discloses a pendulum golf putter.

U.S. Pat. No. 4,746,120 to Mockovak discloses a golf club putter and handgrip therefor.

U.S. Pat. No. Des. 297,040 to Shong discloses the ornamental design for a golf putter.

U.S. Pat. No. 5,046,740 to D'Eath discloses a golf putter.

While these devices fulfill their respective, particular objective and requirements, the aforementioned patents do not describe an adjustable putter grip for securing to a putter to allow a user to putt with arms in a parallel relationship.

In this respect, the adjustable putter grip according to the present invention substantially departs from the conventional concepts and designs of the prior art, and in doing so provides an apparatus primarily developed for the purpose of securing to a putter to allow a user to putt with arms in a parallel relationship.

Therefore, it can be appreciated that there exists a continuing need for new and improved adjustable putter grip which can be used for securing to a putter to allow a user to putt with arms in a parallel relationship. In this regard, the present invention substantially fulfills this need.

SUMMARY OF THE INVENTION

In the view of the foregoing disadvantages inherent in the known types of golf putters now present in the prior art, the present invention provides an improved adjustable putter grip. As such, the general purpose of the present invention, which will be described subsequently in greater detail, is to provide a new and improved adjustable putter grip and method which has all the advantages of the prior art and none of the disadvantages.

To attain this, the present invention essentially comprises a putter comprising of a lower ball striking portion. An elongated shaft extends upwardly from a top surface of the lower ball striking portion. An upper end of the elongated shaft has a gripping handle disposed thereon. The gripping handle has a planar forward surface and a rounded rearward surface. The device includes an attachment handle comprising a base member. The base member has a generally cylindrical configuration. The base member has a recess formed in a front portion thereof intermediate end portions thereof. The recess is dimensioned for receiving the rounded rearward surface of the gripping handle of the putter therein. The base member has a threaded aperture therethrough adjacent to the recess. A notch is formed in the base member extending within the threaded aperture. The attachment handle further comprises a pair of outer handles extending linearly from opposing ends of the base member. The device includes a clamping mechanism comprising an L-shaped clamp portion. The L-shaped clamp portion has a planar exterior member and a cylindrical threaded interior member. The cylindrical threaded interior member extends orthogonally from an end of the planar exterior member. The cylindrical threaded interior member is adjustably received within the threaded aperture of the base member of the attachment handle. A free end of the cylindrical threaded interior member extends outwardly of the threaded aperture and having an adjustment knob secured thereto. A boss of the adjustment knob is dimensioned for positioning within the notch in the base member. The clamping mechanism couples the putter to the attachment handle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new and improved adjustable putter grip which may be easily and efficiently manufactured and marketed.

It is a further object of the present invention to provide a new and improved adjustable putter grip which is of durable and reliable construction.

An even further object of the present invention is to provide a new and improved adjustable putter grip which is susceptible of a low cost of manufacture with regard to both materials and labor, and which accordingly is then susceptible of low prices of sale to the consuming public, thereby making such an adjustable putter grip economically available to the buying public.

Still yet another object of the present invention is to provide a new and improved adjustable putter grip which provides in the apparatuses and methods of the prior art some of the advantages thereof, while simultaneously overcoming some of the disadvantages normally associated therewith.

Even still another object of the present invention is to provide a new and improved adjustable putter grip for securing to a putter to allow a user to putt with arms in a parallel relationship.

Lastly, it is an object of the present invention to provide a new and improved adjustable putter grip including an attachment handle. A clamping mechanism couples a putter to the attachment handle thereby permitting a user to manipulate the putter with their wrists locked and their arms in a parallel relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
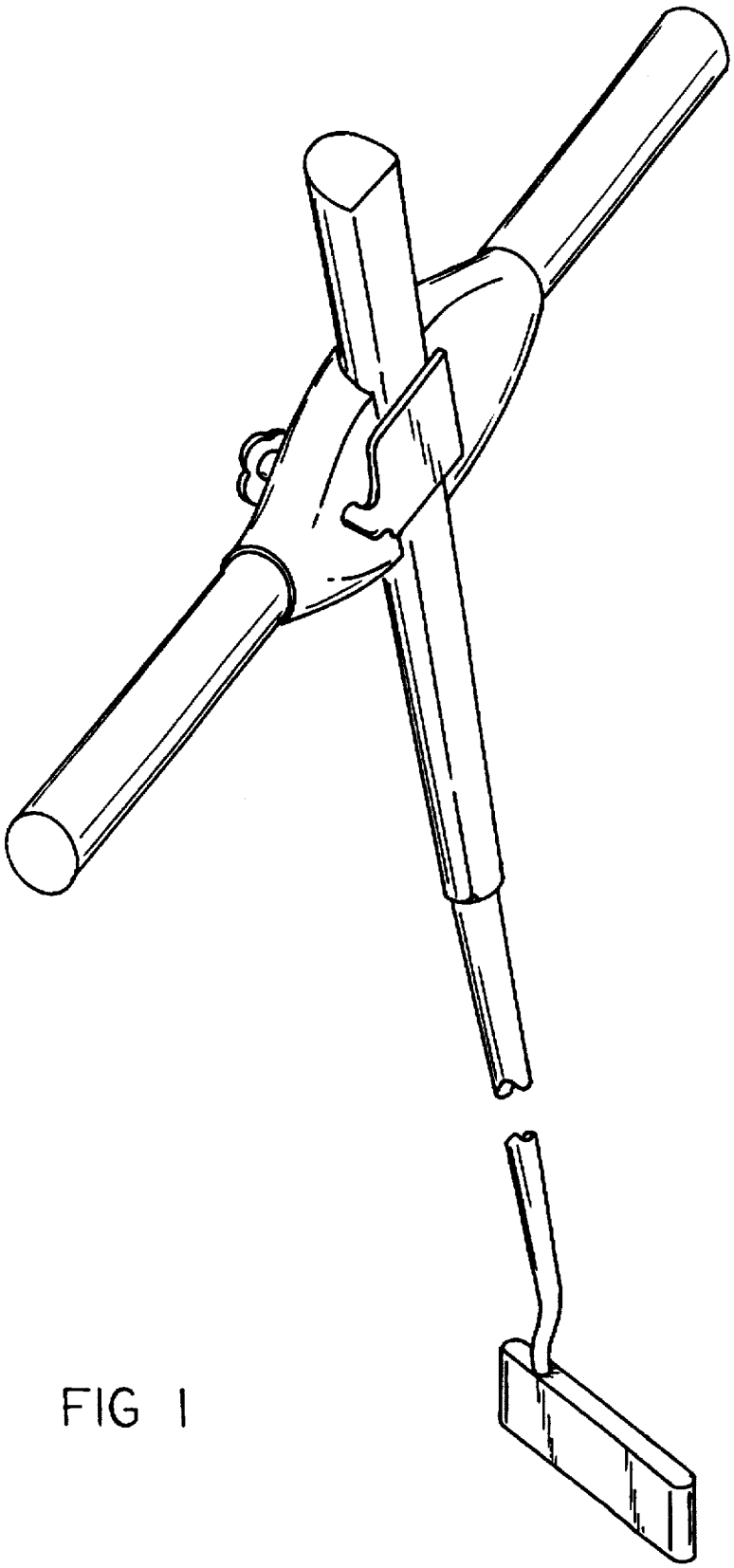
FIG. 1 is a perspective view of the preferred embodiment of the adjustable putter grip constructed in accordance with the principles of the present invention.
Figure 2:
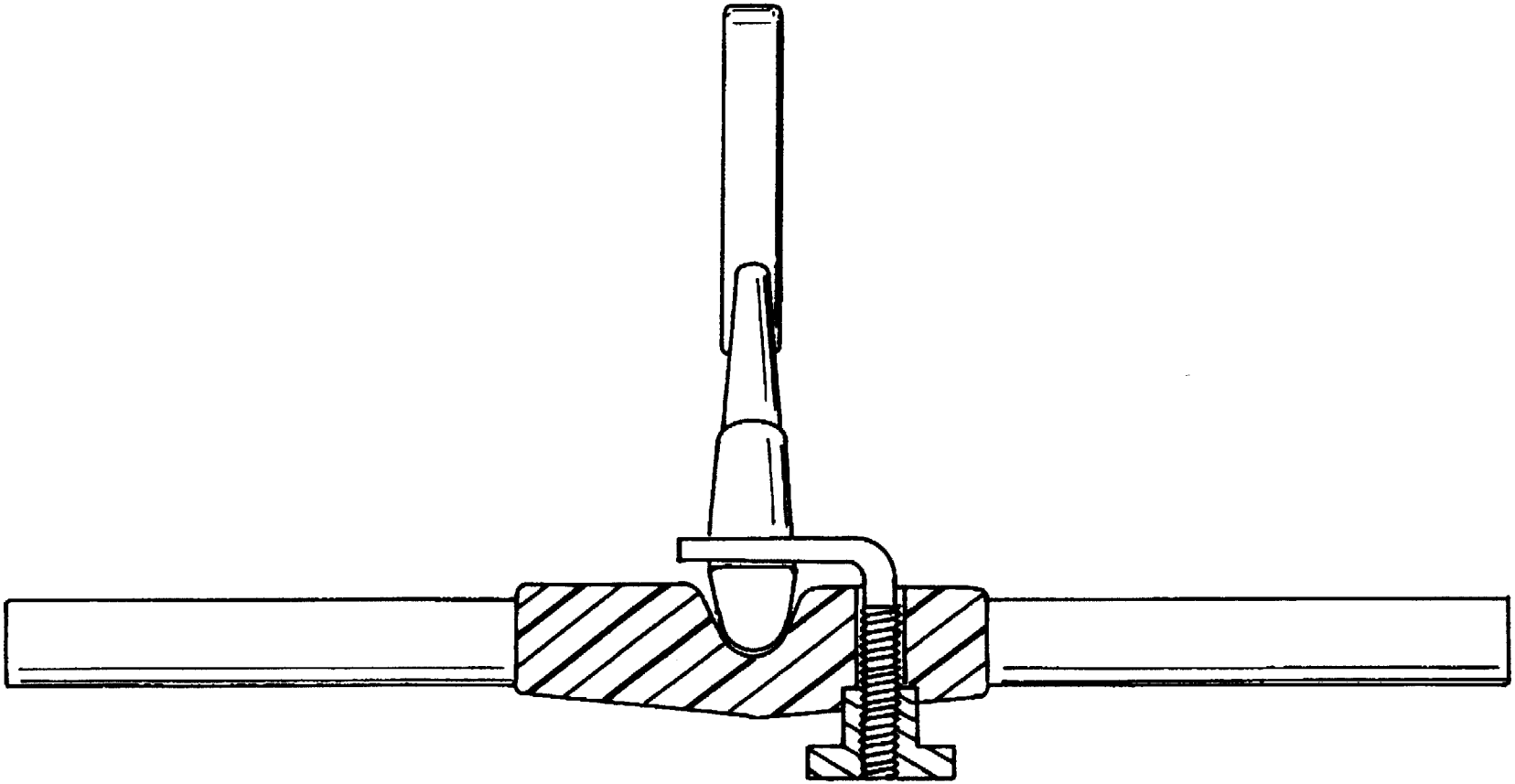
FIG. 2 is a plan view of the present invention illustrated in cross-section as secured to a golf putter.
Figure 3:
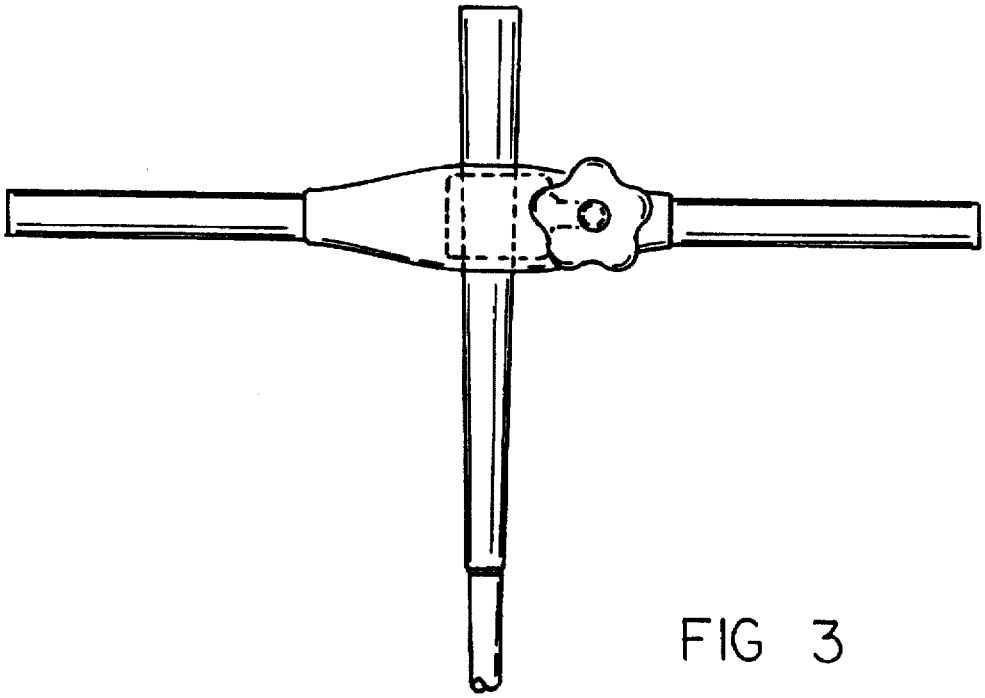
FIG. 3 is a front elevation view of the present invention as secured to the putter.
Figure 4:
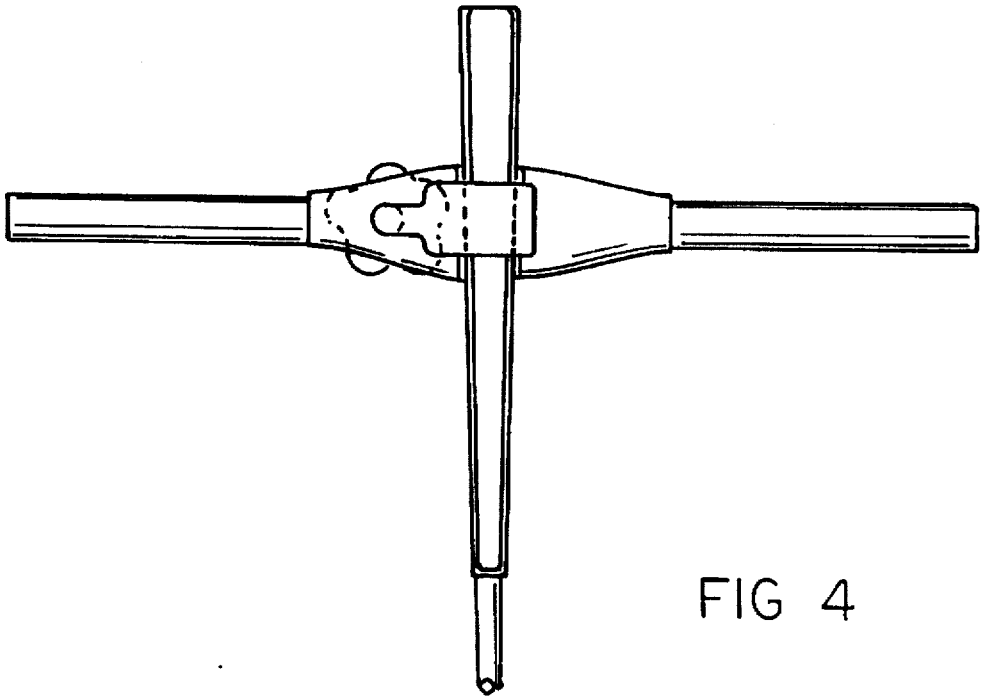
FIG. 4 is a rear elevation view of the present invention as secured to the putter.

With reference now to the drawings, and in particular, to FIGS. 1–4 thereof, the preferred embodiment of the new and improved adjustable putter grip embodying the principles and concepts of the present invention and generally designated by the reference number 10 will be described.

Specifically, it will be noted in the various Figures that the device relates to a adjustable putter grip for securing to a putter to allow a user to putt with arms in a parallel relationship. In its broadest context, the device consists of a putter, an attachment handle and a clamping mechanism. Such components are individually configured and correlated with respect to each other so as to attain the desired objective.

The device 10 includes a putter 12 comprising of a lower ball striking portion 14. An elongated shaft 16 extends upwardly from a top surface of the lower ball striking portion 14. An upper end of the elongated shaft 16 has a gripping handle 18 disposed thereon. The gripping handle 18 has a planar forward surface 20 and a rounded rearward surface 22. The putter 12 resembles putters known in the art. The putter 12 can come in a variety of lengths and styles to suit the user. The shape of the gripping handle 18 can also be varied.

The device 10 also includes an attachment handle 26 comprising a base member 28. The base member 28 has a generally cylindrical configuration. The base member 28 has a recess 30 formed in a front portion thereof intermediate end portions thereof. The recess 30 is dimensioned for receiving the rounded rearward surface 22 of the gripping handle 18 of the putter 12 therein. The base member 28 has a threaded aperture 32 therethrough adjacent to the recess 30. A notch 34 is formed in the base member 28 extending within the threaded aperture 32. The attachment handle 26 further comprises a pair of outer handles 36 extending linearly from opposing ends of the base member 28. The pair of outer handles 36 allow for the user to manipulate the device 10 once the attachment handle 26 is secured to the putter 12.

In association with the attachment handle 26, the device 10 includes a clamping mechanism 40 comprising an L-shaped clamp portion 42. The L-shaped clamp portion 42 has a planar exterior member 44 and a cylindrical threaded interior member 46. The cylindrical threaded interior member 46 extends orthogonally from an end of the planar exterior member 44. The cylindrical threaded interior member 46 is adjustably received within the threaded aperture 32 of the base member 28 of the attachment handle 26. A free end 48 of the cylindrical threaded interior member 46 extends outwardly of the threaded aperture 32 and having an adjustment knob 50 secured thereto. A boss 52 of the adjustment knob 50 is dimensioned for positioning within the notch 34 in the base member 28. The clamping mechanism 40 couples the putter 12 to the attachment handle 26.

In use, the rounded rearward surface 22 of the gripping handle 18 of the putter 12 is positioned within the recess 30 of the base member 28 of the attachment handle 26. The adjustment knob 50 is then tightened to bring the cylindrical threaded interior member 46 inwardly of the threaded aperture 32 thereby abutting the planar exterior member 44 against the planar forward surface 20 of the putter 12. This will position the attachment handle 26 in an orthogonal relationship with respect to the putter 12. The user will place their hands around the pair of outer handles 36 with the arms in a parallel relationship with respect to a ground surface. In practice, this will keep the user's wrists locked while attempting a putting stroke.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A putter in combination with an adjustable putter grip for securing to the putter to allow a user to putt with arms in a parallel relationship comprising, in combination:

a putter comprising of a lower ball striking portion, an elongated shaft extends upwardly from a top surface of the lower ball striking portion, an upper end of the elongated shaft having a gripping handle disposed thereon, the gripping handle having a planar forward surface and a rounded rearward surface;

an attachment handle comprising a base member, the base member having generally cylindrical configuration, the base member having a recess formed in a front portion thereof intermediate end portions thereof, the recess being dimensioned for receiving the rounded rearward surface of the gripping handle of the putter therein, the base member having a threaded aperture therethrough adjacent to the recess, a notch formed in the base member extending within the threaded aperture, the attachment handle further comprising a pair of integrally formed outer handles in axial alignment extending linearly from opposing ends of the base member;

a clamping mechanism comprising an L-shaped clamp portion, the L-shaped clamp portion having a planar exterior member and a cylindrical threaded interior member, the cylindrical threaded interior member extending orthogonally from an end of the planar exterior member, the cylindrical threaded interior member adjustably received within the threaded aperture of the base member of the attachment handle, a free end of the cylindrical threaded interior member extending outwardly of the threaded aperture and having an adjustment knob secured thereto, a boss of the adjustment knob being dimensioned for positioning within the notch in the base member, the clamping mechanism adjustably coupling the putter to the attachment handle with the planar exterior member abutting the planar forward surface of the gripping handle of the putter and adjustable along a length thereof beneath an upper end of the gripping handle.

2. A putter in combination with an adjustable putter grip comprising:

an attachment handle comprising a base member, the base member having generally cylindrical configuration, the base member having a recess formed in a front portion thereof intermediate end portions thereof, the recess being dimensioned for receiving a rounded rearward surface of a handle of the putter therein, the attachment handle further comprising a pair of integrally formed outer handles in axial alignment extending linearly from opposing ends of the base member;

a clamping mechanism for coupling a putter to the attachment handle, the clamping mechanism comprising an L-shaped clamp portion, the L-shaped clamp portion having a planar exterior member and a cylindrical threaded interior member, the cylindrical threaded interior member extending orthogonally from an end of the planar exterior member, the clamping mechanism adjustably coupling the attachment handle along a length of a handle of the putter at any portion beneath an upper end of the handle of the putter.

3. The putter in combination with an adjustable putter grip as set forth in claim 2 wherein the attachment handle having a threaded aperture therethrough, the cylindrical threaded interior member adjustably received within the threaded aperture of the attachment handle.

4. The putter in combination with an adjustable putter grip as set forth in claim 3 wherein a free end of the cylindrical threaded interior member extending outwardly of the threaded aperture and having an adjustment knob secured thereto.

5. The putter in combination with an adjustable putter grip as set forth in claim 4 wherein a boss of the adjustment knob being dimensioned for positioning within a notch formed in the attachment handle.

6. The putter in combination with an adjustable putter grip as set forth in claim 2 and further including a putter comprising a lower ball striking portion, an elongated shaft extends upwardly from a top surface of the lower ball striking portion, an upper end of the elongated shaft having a gripping handle disposed thereon, the gripping handle having a planar forward surface and a rounded rearward surface.

* * * * *